US009285720B2

(12) United States Patent
Murata et al.

(10) Patent No.: US 9,285,720 B2
(45) Date of Patent: Mar. 15, 2016

(54) IMAGE FORMING APPARATUS INCLUDING MOISTURE REMOVAL MECHANSISM FOR REMOVING MOSITURE ON SURFACE OF PHOTOSENSITIVE DRUM

(71) Applicant: KYOCERA Document Solutions Inc., Osaka (JP)

(72) Inventors: Takahiko Murata, Osaka (JP); Shigeki Tsukahara, Osaka (JP); Ai Takagami, Osaka (JP); Koichi Hayashi, Osaka (JP); Nobuyuki Hayashi, Osaka (JP); Yosuke Saito, Osaka (JP); Maki Ike, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 75 days.

(21) Appl. No.: 14/175,807

(22) Filed: Feb. 7, 2014

(65) Prior Publication Data

US 2014/0294409 A1 Oct. 2, 2014

(30) Foreign Application Priority Data

Mar. 26, 2013 (JP) ..... 2013-064496

(51) Int. Cl.

| | |
|---|---|
| ***G03G 15/00*** | (2006.01) |
| ***G03G 15/16*** | (2006.01) |
| ***G03G 15/02*** | (2006.01) |
| ***G03G 21/20*** | (2006.01) |

(52) U.S. Cl.

CPC ..... *G03G 15/161* (2013.01); *G03G 15/0266* (2013.01); *G03G 15/5033* (2013.01); *G03G 21/20* (2013.01); *G03G 21/203* (2013.01); *G03G 2215/00084* (2013.01); *G03G 2215/0132* (2013.01)

(58) Field of Classification Search

CPC ..... G03G 15/0266; G03G 15/5033; G03G 15/751; G03G 21/20; G03G 2215/00084

USPC ..... 399/44, 50, 96, 159, 176

See application file for complete search history.

(56) References Cited

U.S. PATENT DOCUMENTS

| | | | | |
|---|---|---|---|---|
| 6,970,661 | B2 * | 11/2005 | Shoji | 399/50 |
| 7,599,642 | B2 * | 10/2009 | Nakajima et al. | 399/100 |
| 8,335,450 | B1 * | 12/2012 | Daloia et al. | 399/96 |

(Continued)

FOREIGN PATENT DOCUMENTS

| | | | |
|---|---|---|---|
| JP | 60156068 A | * | 8/1985 |
| JP | 2000267405 A | * | 9/2000 |

(Continued)

*Primary Examiner* — Robert Beatty

(74) *Attorney, Agent, or Firm* — Stein IP, LLC

(57) ABSTRACT

An image forming apparatus has an image carrying body, a first electrically conductive member, a bias application device, and a controller. The first electrically conductive member makes contact with the photosensitive layer of the image carrying body The bias application device applies a bias containing an AC bias to the first electrically conductive member. The controller controls the bias application device. The image forming apparatus can execute, while no image formation is being performed, a temperature raising mode in which, with the first electrically conductive member in contact with the image carrying body outside the image formation region, an AC bias having a peak-to-peak value twice as high as the discharge start voltage between the first electrically conductive member and the image carrying body is applied to the first electrically conductive member to raise the temperature of the surface of the image carrying body.

14 Claims, 10 Drawing Sheets

(56) References Cited

U.S. PATENT DOCUMENTS

2014/0294410 A1* 10/2014 Hayashi et al. ..... 399/44
2014/0308053 A1* 10/2014 Tsukahara et al. ..... 399/96

FOREIGN PATENT DOCUMENTS

JP 2007-94354 A 4/2007
JP 2012-141541 A 7/2012

* cited by examiner

IMAGE FORMING APPARATUS INCLUDING MOISTURE REMOVAL MECHANSISM FOR REMOVING MOSITURE ON SURFACE OF PHOTOSENSITIVE DRUM

CROSS-REFERENCE TO RELATED APPLICATIONS

This application is based upon and claims the benefit of priority from the corresponding Japanese Patent Application No. 2013-64496 filed on Mar. 26, 2013, the entire contents of which are incorporated herein by reference.

BACKGROUND OF THE INVENTION

The present disclosure relates to an image forming apparatus employing a photosensitive drum, and more particularly to a method of removing moisture from the surface of a photosensitive drum.

In image forming apparatuses, such as copiers, printers, and facsimile machines, that rely on electrophotography, developer (hereinafter referred to also as toner) in powder form is typically used. According to a commonly adopted process, an electrostatic latent image formed on an image carrying body such as a photosensitive drum is made visible with toner stored in a developing device, and the toner image is then transferred onto a recording medium and is then fused. The photosensitive drum has a photosensitive layer with a thickness of ten micrometers to several tens of micrometers formed on the surface of a cylindrical base member. Depending on the main material of the photosensitive layer, photosensitive drums are classified into organic photosensitive drums, selenium-phosphorous photosensitive drums, amorphous silicon (hereinafter abbreviated to a-Si) photosensitive drums, etc.

Organic photosensitive drums are comparatively inexpensive, but wear easily and require frequent replacement. Selenium-phosphorous photosensitive drums have longer lifetimes than organic ones, but are difficult to handle because of the toxicity of their material. In contrast, a-Si photosensitive drums are expensive as compared with organic ones, but are easy to handle because of the non-toxicity of their material, have high hardness and excellent durability (five times as high as organic ones), and exhibit almost no deterioration in their properties as photosensitive drums even after a long period of use, maintaining high image quality. These thus serve as excellent image carrying bodies with low running cost and high safety to the environment.

It is known that image forming apparatuses employing such photosensitive drums are, due to their properties, depending on the conditions of use, prone to so-called image dropouts, which make the formed image scratchy, or blurred at the edge. Image dropouts occur by the following mechanism. When the surface of a photosensitive drum is electrically charged by a charging device, the electric discharge by the charging device generates ozone. The ozone decomposes components of the atmosphere, generating ionic products such as NOx and SOx. These ionic products are water-soluble, and thus adhere to the photosensitive drum and bite into the coarse structure with an asperity of about 0.1 μm at the surface of the photosensitive drum. They thus cannot be removed by a cleaning system employed in general-purpose products, and they even absorb moisture in the atmosphere and reduce the resistance at the surface of the photosensitive drum. This causes a lateral flow of potential at the edge of the electrostatic latent image formed on the surface of the photosensitive drum, possibly resulting in image dropouts. This phenomenon is particularly notable with a-Si photosensitive drums, which are less prone to surface wear against a blade or the like and which have at the surface a molecular structure that easily absorbs moisture.

There have conventionally been proposed various methods for preventing occurrence of such image dropouts. For example, according to one known method, a heat generating body (heater) is provided inside a photosensitive drum, or inside a sliding member that is in contact with a photosensitive drum, and heat is generated by controlling the heat generating body according to temperature and humidity detected by a temperature/humidity sensor inside the apparatus so as to evaporate moisture that has attached to the surface of the photosensitive drum, thereby to prevent occurrence of image dropouts.

However, the method relying on a heater arranged inside a photosensitive drum requires use of sliding electrodes for connection between the heater and a power supply. Due to the presence of sliding parts for connection between the heater and the power supply, inconveniently, as the total rotation period of the photosensitive drum increases, the sliding parts become prone to bad contacts. Moreover, in the current trend for energy saving and environment-friendliness, there is a strong demand for reduced electric power consumption during standing-by and during ordinary printing. In particular, in apparatuses having a plurality of drum units, such as tandem-type full-color image forming apparatuses, their electric power consumption is high, and therefore it is not desirable to incorporate a heater. Heat around a cassette heater or a fusing device may be transferred to around a photosensitive drum, but this is ineffective because a component nearby, such as a developing device, is also heated.

Thus, there is known an image forming apparatus in which a weak charge period in which a charge voltage containing a DC voltage alone or a charge voltage having an AC voltage lower than during image formation is superimposed on a DC voltage is provided in a predetermined period before the start of, or after the end of, a regular charge period or between a plurality of regular charge periods so as to suppress generation of electric discharge products resulting from application of a charge bias other than during image formation.

There is also known an image forming apparatus that can execute a moisture removal mode in which are sequentially performed a first moisture removal process in which moisture is removed from the surface of a photosensitive drum with a cleaning blade, a second moisture removal process in which toner on a developing roller is transported to the photosensitive drum and moisture on the surface of the photosensitive drum is absorbed in the toner and is removed together with the toner, and a third moisture removal process in which a voltage is applied to a charging roller to remove moisture on the surface of the charging roller and the photosensitive drum.

SUMMARY OF THE INVENTION

An object of the present disclosure is to provide an image forming apparatus that can efficiently remove moisture on the surface of an image carrying body before the start of printing operation.

According to one aspect of the present disclosure, an image forming apparatus has an image carrying body, a first electrically conductive member, a bias application device, and a controller, and performs image formation on the surface of the image carrying body while rotating it. The image carrying body has a photosensitive layer formed on its circumferential surface. The first electrically conductive member makes contact with the photosensitive layer of the image carrying body The bias application device applies a bias containing an AC bias to the first electrically conductive member. The controller controls the bias application device. The image forming apparatus can execute, while no image formation is being performed, a temperature raising mode in which, with the first electrically conductive member in contact with the image carrying body outside the image formation region, an AC bias having a peak-to-peak value twice as high as the discharge start voltage between the first electrically conductive member and the image carrying body is applied to the first electrically conductive member to raise the temperature of the surface of the image carrying body.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
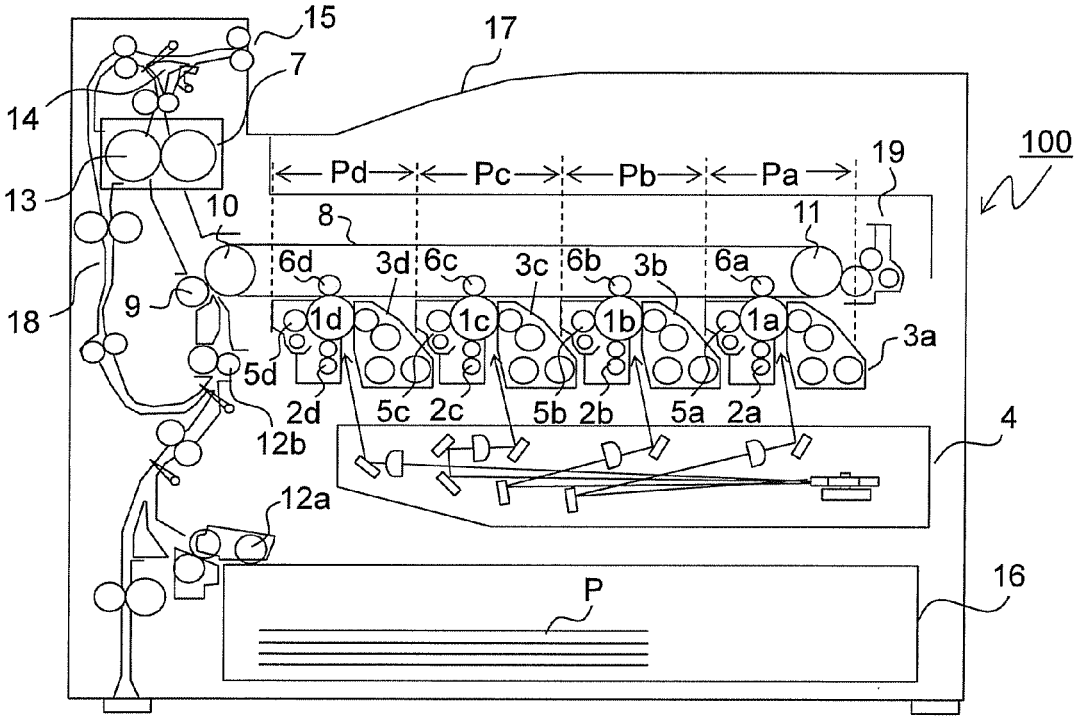
FIG. 1 is a schematic sectional view showing an overall structure of a color printer 100 according to a first embodiment of the present disclosure.

Hereinafter, with reference to the accompanying drawings, embodiments of the present disclosure will be described. FIG. 1 is a schematic diagram showing the structure of a color printer 100 (an image forming apparatus) according to a first embodiment of the present disclosure. Inside the body of the color printer 100, four image formation sections Pa, Pb, Pc, and Pd are arranged from the upstream side (the right side in FIG. 1) with respect to the transport direction. These image formation sections Pa to Pd are provided for images of four different colors (cyan, magenta, yellow, and black) respectively, and form cyan, magenta, yellow, and black images sequentially, each through charging, exposing, developing, and transferring processes.

The image formation sections Pa to Pd are provided with photosensitive drums 1*a*, 1*b*, 1*c*, and 1*d*, respectively, for carrying visible images (toner images) of the different colors, and here, a-Si photosensitive drums are used which have an a-Si photosensitive layer formed on the outer circumferential surface of an aluminum drum. Furthermore, an intermediary transfer belt 8 which is rotated in the clockwise direction in FIG. 1 by a driving means (not illustrated) is provided beside the image formation sections Pa to Pd. The toner images formed on the photosensitive drums 1*a* to 1*d* are primarily transferred, sequentially so as to be superimposed on one another, to the intermediary transfer belt 8 which moves while in contact with the photosensitive drums 1*a* to 1*d*, are then secondarily transferred, by the action of a secondary transfer roller 9, to transfer paper P as one example of a recording medium, are then fused on the transfer paper P, and are then discharged out of the apparatus body. For example, while the photosensitive drums 1*a* to 1*d* are rotated in the counterclockwise direction in FIG. 1, the image formation process with respect to the photosensitive drums 1*a* to 1*d* is performed.

The transfer paper P to which the toner images are transferred is accommodated inside a paper cassette 16 in a lower part of the apparatus, and is transported via a paper feed roller 12*a* and a registration roller pair 12*b* to the secondary transfer roller 9. For the intermediary transfer belt 8, a sheet of a dielectric resin is used, and here, a belt with no seam (a seamless belt) is typically used. On the upstream side of the photosensitive drum 1*a* with respect to the rotation direction of the intermediary transfer belt 8, a belt cleaning unit 19 is arranged opposite a tension roller 11 across the intermediary transfer belt 8.

Next, the image formation sections Pa to Pd will be described. Around and under the photosensitive drums 1*a* to 1*d*, which are rotatably arranged, there provided charging devices 2*a*, 2*b*, 2*c*, and 2*d* which electrically charge the photosensitive drums 1*a* to 1*d*, an exposure unit 4 which exposes the photosensitive drums 1*a* to 1*d* to image information, developing devices 3*a*, 3*b*, 3*c*, and 3*d* which form toner images on the photosensitive drums 1*a* to 1*d*, and cleaning devices 5*a* to 5*d* which removes developer (toner) that remains on the photosensitive drums 1*a* to 1*d*.

Figure 2:
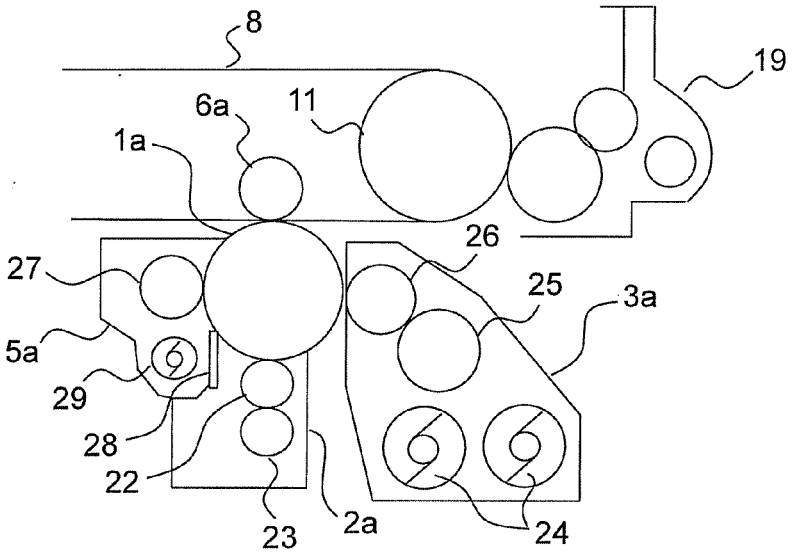
FIG. 2 is a partly enlarged view around the image formation section Pa in FIG. 1.

Now, with reference to FIG. 2, the image formation section Pa will be described in detail. The image formation sections Pb to Pd are basically configured similarly, and therefore no overlapping description will be repeated. As shown in FIG. 2, around the photosensitive drum 1*a*, there are arranged, in the drum rotation direction (the counter-clockwise direction in FIG. 1), a charging device 2*a*, a developing device 3*a*, and a cleaning device 5*a*, and across the intermediary transfer belt 8, a primary transfer roller 6*a*.

The charging device 2*a* has a charging roller 22 which makes contact with the photosensitive drum 1*a* to apply a charge bias to the drum surface and a charger cleaning roller 23 for cleaning the charging roller 22. The charging roller 22 has a roller body of an electrically conductive material such as epichlorohydrin rubber formed on the circumferential surface of a metal shaft.

The developing device 3*a* has two stirring transport screws 24, a magnetic roller 25, and a developing roller 26, and applies to the developing roller 26 a developing bias of the same polarity (positive) as toner to make the toner fly onto the drum surface.

The cleaning device 5*a* has a cleaning roller 27, a cleaning blade 28, and a collecting screw 29. The cleaning roller 27 is kept in pressed contact with the photosensitive drum 1*a* under a predetermined pressure, and is driven, by an unillustrated driving means, to rotate in the same direction as the photosensitive drum 1*a* at the surface of contact with it, with the peripheral speed of the former controlled to be higher than (here, 1.2 times as high as) the peripheral speed of the latter. The cleaning roller 27 has, for example, a structure where a layer of a foamed material of EPDM rubber with an Asker C hardness of 55° is formed as a roller body around a metal shaft. The material for the roller body is not limited to EPDM rubber but may instead be rubber or foamed rubber of any other material, preferably with an Asker C hardness in the range from 10° to 90°.

On the surface of the photosensitive drum 1*a*, on the downstream side of the surface of contact with the cleaning roller 27 with respect to the rotation direction, the cleaning blade 28 is fixed in a state kept in contact with the photosensitive drum 1*a*. For the cleaning blade 28, for example, a blade of polyurethane with a JIS hardness of 78° is used, and this is fitted at a predetermined angle with respect to the direction normal to the photosensitive drum as observed at the point of contact. With respect to the cleaning blade 28, its material, hardness, dimensions, overlap on the photosensitive drum 1*a*, pressure of contact, etc. are set appropriately according to the specifications of the photosensitive drum 1*a*.

The residual toner removed from the surface of the photosensitive drum 1*a* by the cleaning roller 27 and the cleaning blade 28 is, as the collecting screw 29 rotates, discharged out of the cleaning device 5*a*, and is transported to a toner collection container (not illustrated) to be stored there. The toner used in the present disclosure is, for example, toner in which silica, titanium oxide, strontium titanate, alumina, or the like is buried as abrasive in the surface of toner particles so as to partly protrude, or toner in which abrasive is electrostatically adhered to the toner surface.

When a user enters an instruction to start image formation, first, the charging devices 2*a* to 2*d* electrically charge the surface of the photosensitive drums 1*a* to 1*d* uniformly, and then the exposure unit 4 irradiates the photosensitive drums 1*a* to 1*d* with light so as to form on them electrostatic latent images according to image signals. The developing devices 3*a* to 3*d* are provided with developing rollers arranged opposite the photosensitive drums 1*a* to 1*d*, and are loaded with predetermined quantities of two-component developer containing yellow, cyan, magenta, and black toner respectively. The toner is supplied from the developing rollers 26 of the developing devices 3*a* to 3*d* onto the photosensitive drums 1*a* to 1*d*, and electrostatically adhere to them. Through exposure to the light from the exposure unit 4, toner images are formed according to the thus formed electrostatic latent images.

Then, by the primary transfer rollers 6*a* to 6*d*, an electric field is applied at a predetermined transfer voltage between the primary transfer rollers 6*a* to 6*d* and the photosensitive drums 1*a* to 1*d*, and the yellow, cyan, magenta, and black toner images on the photosensitive drums 1*a* to 1*d* are primarily transferred to the intermediary transfer belt 8. These images of four colors are formed in a previously determined positional relationship with one another for formation of a predetermined full-color image. Then, in preparation for subsequent formation of new electrostatic latent images, the toner remaining on the surface of the photosensitive drums 1*a* to 1*d* is removed by the cleaning devices 5*a* to 5*d*, and the residual electric charge is eliminated by an antistatic lamp (not illustrated).

The intermediary transfer belt 8 is wound around a plurality of pivoted rollers including a following roller 10 and a driving roller 11. When a driving motor (not illustrated) makes the driving roller 11 rotate, and thus the intermediary transfer belt 8 starts to rotate in the clockwise direction, the transfer paper P is transported, with predetermined timing, from the registration roller pair 12*b* to the secondary transfer roller 9 provided beside the intermediary transfer belt 8, and at the nip portion (secondary transfer nip portion) between the intermediary transfer belt 8 and the secondary transfer roller 9, a full-color image is secondarily transferred to the transfer paper P. The transfer paper P having the toner images transferred to it is transported to a fusing section 7.

The transfer paper P transported to the fusing section 7 is then, as it passes through the nip portion (fusing nip portion) between a fusing roller pair 13, heated and pressed, so that the toner images are fused on the surface of the transfer paper P, and thus a predetermined full-color image is formed. The transfer paper P having the full-color image formed on it is distributed, by a branching section 14, into one of different transport directions into which it branches. In a case where an image is formed only on one side of the transfer paper P, the transfer paper P is, as it is, discharged by a discharge roller pair 15 onto a discharge tray 17.

On the other hand, in a case where images are formed on both sides of the transfer paper P, part of the transfer paper P having passed through the fusing section 7 is made to protrude from the discharge roller pair 15 out of the apparatus.

Then, the discharge roller pair 15 is rotated in the reverse direction, so that the transfer paper P is distributed by the branching section 14 into a reverse transport passage 18. Thus, the transfer paper P is transported once again, with the image side reversed, to the registration roller pair 12*b*. Then, the next image formed on the intermediary transfer belt 8 is transferred by the secondary transfer roller 9 to the side of the transfer paper P where no image has yet been formed. The transfer paper P is then transported to the fusing section 7, where the toner images are fused, and is then discharged onto the discharge tray 17.

Figure 3:
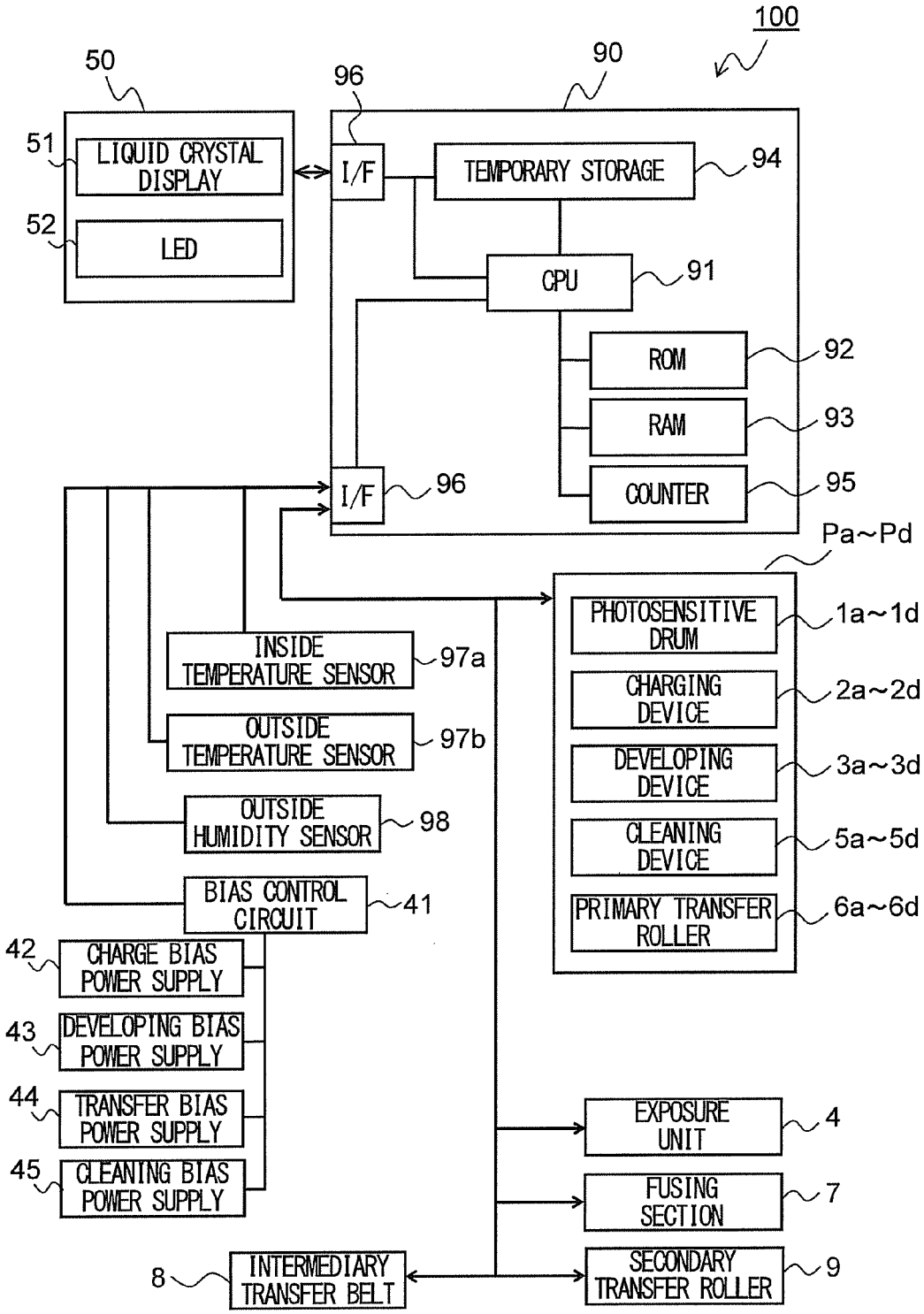
FIG. 3 is a block diagram showing control paths in a color printer 100 according to the first embodiment of the present disclosure.

Next, the control paths in an image forming apparatus according to the present disclosure will be described. FIG. 3 is a block diagram in illustration of one embodiment of a controlling means used in a color printer 100 according to a first embodiment of the present disclosure. Incidentally, when the color printer 100 is used, its different parts are controlled in various manners, and this complicates the control paths in the entire color printer 100. The following description is focused on those parts of the control paths which are essential to implementation of the present disclosure.

A control section 90 is provided with, at least, a CPU 91 as a central processing unit, a ROM (read-only memory) 92 which is a read-only storage, a RAM (random access memory) 93 which is a randomly rewritable storage, a temporary storage 94 for temporary storage of image data, a counter 95, and a plurality of I/Fs. (interfaces) 96 for transmitting control signals to individual devices inside the color printer 100 and receiving input signals from an operation section 50. The control section 90 may be arranged at an arbitrary position inside the body of the color printer 100.

In the ROM 92 are stored, among others, data that remain unchanged during the use of the color printer 100, such as control programs for the color printer 100 and values needed for control. In the RAM 93 are stored, among others, necessary data generated in the course of the control of the color printer 100 and data that are temporarily needed during the control of the color printer 100. The counter 95 counts the number of sheets printed. The counter 95 may be omitted, in which case, for example, the number of sheets printed may be stored in the RAM 93.

The control section 90 causes the CPU 91 to transmit control signals via the I/Fs 96 to different parts and devices in the color printer 100. Also, from those different parts and devices, signals representing their states and input signals are transmitted via the I/Fs 96 to the CPU 91. In this embodiment, the different parts and devices controlled by the control section 90 include, for example, the image formation sections Pa to Pd, the exposure unit 4, the primary transfer rollers 6*a* to 6*d*, the fusing section 7, the secondary transfer roller 9, an image input section 40, a bias control circuit 41, and an operation section 50.

The image input section 40 is a receiving section which receives image data transmitted from a personal computer or the like to the color printer 100. An image signal inputted via the image input section 40 is converter into a digital signal, and is then sent out to the temporary storage 94.

The bias control circuit 41 is connected to a charge bias power supply 42, a developing bias power supply 43, a transfer bias power supply 44, and a cleaning bias power supply 45, and causes these power supplies 42 to 45 to operate according to output signals from the control section 90. The power supplies 42 to 45 operate as follows: according to control signals from the bias control circuit 41, the charge bias power supply 42 applies a predetermined bias to the charging rollers 22 in the charging devices 2*a* to 2*d*, the developing bias power supply 43 applies a predetermined bias to the magnetic roller 25 and the developing rollers 26 in the developing devices 3*a* to 3*d*, the transfer bias power supply 44 applies a predetermined bias to the primary transfer rollers 6*a* to 6*d* and the secondary transfer roller 9, and the cleaning bias power supply 45 applies a predetermined bias to the cleaning rollers 27 in the cleaning devices 5*a* to 5*d*.

The operation section 50 is provided with a liquid crystal display 51 and LEDs 52 indicating various states, so as to indicate the status of the color printer 100, the progress of image formation, and the number of copies printed. Various settings on the color printer 100 are made from a printer driver on the personal computer.

The operation section 50 is further provided with a stop/clear button used, for example, to stop image formation, a reset button used to restore the default settings of the color printer 100, etc.

An inside temperature sensor 97*a* detects the temperature inside the color printer 100, in particular the temperature at the surface of, or around, the photosensitive drums 1*a* to 1*d*, and is arranged beside the image formation sections Pa to Pd. An outside temperature sensor 97*b* detects the temperature outside the color printer 100, and an outside humidity sensor 98 detects the humidity outside the color printer 100. The outside temperature sensor 97*b* and the outside humidity sensor 98 are arranged, for example, beside a suction duct (not illustrated) provided at the side of the paper cassette 16 in FIG. 1, where they are insusceptible to the influence of heat-generating parts, but may be arranged at any other place where they can accurately detect the temperature and humidity outside the color printer 100.

When the color printer 100 according to this embodiment is not performing image formation, for example, while the color printer 100 is being started up out of a power-off state or a sleep (power-saving) mode into a printing-ready state, a temperature raising mode can be executed in which, with the charging roller 22 kept in contact with the photosensitive drum 1*a* to 1*d* outside the image formation region, an alternating-current (AC) bias is applied to the charging roller 22 to raise the temperature of the surface of the photosensitive drum 1*a* to 1*d*.

The metal shaft and the roller body of an electrically conductive material such as epichlorohydrin rubber, which together constitute the charging roller 22, differ greatly in electric resistance. Thus, applying an AC bias to the charging roller 22 causes heat to be generated between the shaft and the roller body, or inside the roller body. The heat generated in the charging roller 22 is conducted to the photosensitive drum 1*a* to 1*d* to raise the temperature of the surface of the photosensitive drum 1*a* to 1*d*.

Figure 4:
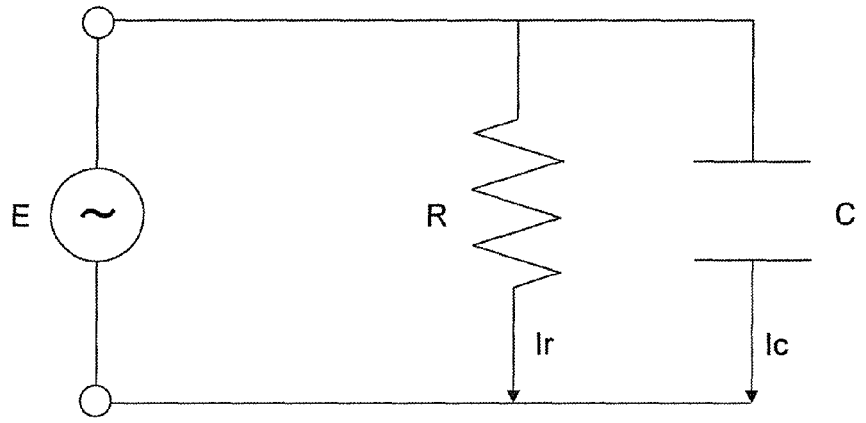
FIG. 4 is a diagram showing an equivalent circuit in illustration of the principle by which application of an AC bias to a charging roller 22 causes the temperature of a photosensitive drum 1*a* to 1*d* to rise.

The principle by which the temperature of the surface of the photosensitive drum 1*a* to 1*d* rises may instead be considered as follows. The charging roller 22 and the photosensitive drum 1*a* to 1*d* are dielectric bodies. Their relationship can be represented by an equivalent circuit composed of a capacitor and a resistor as shown in FIG. 4. When an electric field is applied to a dielectric body, electrons and ions present inside the dielectric body polarize and positive and negative dipoles tend to align in the direction of the electric field. In an electric field of a high-frequency AC current of several megahertz to several hundred megahertz which switches polarities millions of times a second, friction resulting from the violent movement of the dipoles attempting to follow the reversing of the electric field generates heat.

For example, in the equivalent circuit of the photosensitive drum 1*a* to 1*d* and the charging roller 22 as shown in FIG. 4, let the AC bias applied be E, the frequency be f, the resistance of the entire system be R, and the capacitance be C, then a current Ir in phase with the applied bias E generates heat P=E×Ir.

Here, suppose the angular frequency $\omega=2\pi f$ and $|Ir(j\omega)|/|Ic(j\omega)|=\tan\delta$, then $\tan\delta=1/(2\pi f\cdot CR)$ and $1/R=2\pi f\cdot C\cdot\tan\delta$. Hence, the electric power expended for generating heat is given by $P=E\cdot|Ir(j\omega)|=E^2/R=E^2\cdot(2\pi f\cdot C\cdot\tan\delta)$. Thus, the rise in temperature is considered to be proportional to the square of the applied bias E, the frequency f, and the capacitance C.

With this configuration, the temperature of the photosensitive drum 1*a* to 1*d* itself rises. Accordingly, compared with a configuration where a heater is arranged inside or outside the photosensitive drum 1*a* to 1*d*, no energy is required to heat anything else, such as the atmosphere (air) around the photosensitive drum, and thus efficient temperature raising is possible. Incidentally, in a case where the bias applied to the charging roller 22 is a direct-current (DC) bias, the effect of raising temperature is nonexistent or extremely small. It is therefore necessary to apply an AC bias.

Figure 5A:
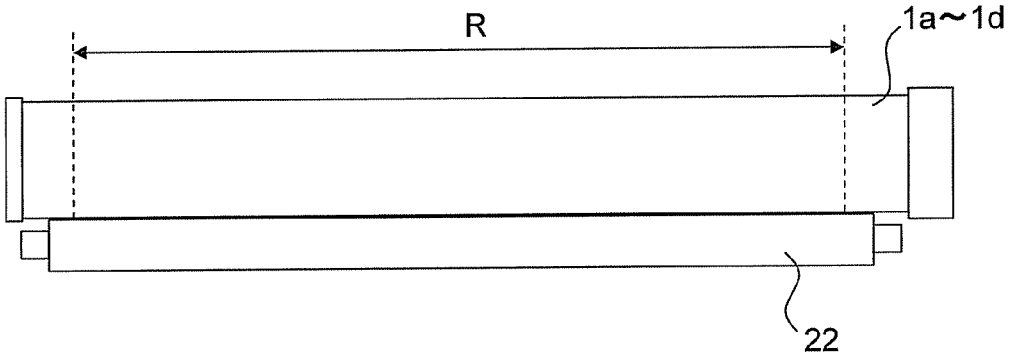
FIG. 5A is a plan view showing a positional relationship between a photosensitive drum 1*a* to 1*d* and a charging roller 22 during printing operation in a color printer 100 according to the first embodiment.
Figure 5B:
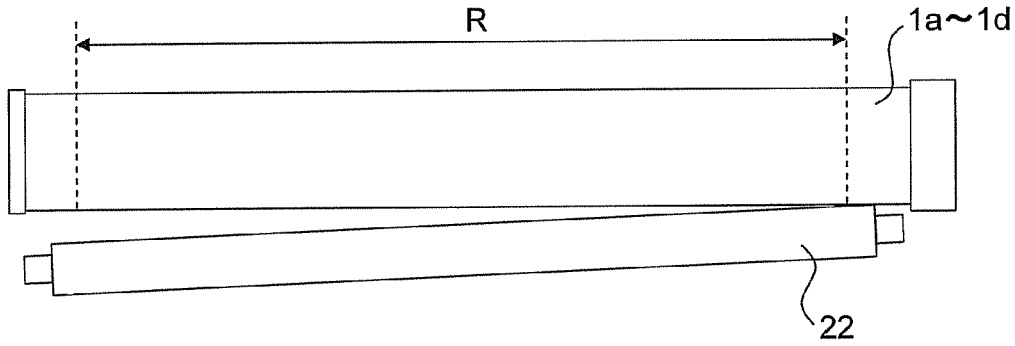
FIG. 5B is a plan view showing a positional relationship between a photosensitive drum 1*a* to 1*d* and a charging roller 22 during execution of a temperature raising mode in a color printer 100 according to the first embodiment.

FIGS. 5A and 5B are plan views showing the positional relationship between the photosensitive drum 1*a* to 1*d* and the charging roller 22 during printing operation and during execution of the temperature raising mode in the color printer 100 according to the first embodiment. During printing operation, as shown in FIG. 5A, the charging roller 22 is arranged parallel to the photosensitive drum 1*a* to 1*d*, and the circumferential surface of the charging roller 22 is in contact with the image formation region R of the photosensitive drum 1*a* to 1*d* over the entire area in its width direction. This permits the image formation region R to be electrically charged uniformly.

On the other hand, during execution of the temperature raising mode, as shown in FIG. 5B, the charging roller 22 is arranged with an inclination to the photosensitive drum 1*a* to 1*d*, and only one end part of the charging roller 22 is in contact with the photosensitive drum 1*a* to 1*d* outside the image formation region R. Thus, even if application of the AC bias to the charging roller 22 during execution of the temperature raising mode promotes electrostatic destruction (dielectric breakdown) of the photosensitive layer at the surface of the photosensitive drum 1*a* to 1*d*, the electrostatic destruction progresses outside the image formation region R where the end part of the charging roller 22 is in contact. This prevents an adverse effect on the image.

Thus, through execution of the temperature raising mode, it is possible to remove moisture on the photosensitive drum 1*a* to 1*d* efficiently for a short time, thereby to effectively suppress occurrence of image dropouts for a long period, and also to suppress image defects resulting from dielectric breakdown of the photosensitive layer at the surface of the photosensitive drum 1*a* to 1*d* accompanying application of the AC bias to the charging roller 22. Moreover, during execution of the temperature raising mode, only part of the charging roller 22 is in contact with the photosensitive drum 1*a* to 1*d*, and thus it is also possible to suppress depression in the side surface of the charging roller 22 resulting from contact with the photosensitive drum 1*a* to 1*d*.

One method of inclining the charging roller 22 relative to the photosensitive drum 1*a* to 1*d* is to move one of the bearings (not illustrated) which rotatably support the shaft of the charging roller 22 at both ends in a direction away from the photosensitive drum 1*a* to 1*d* by means of a cam mechanism, a gear, or the like.

Figure 6A:
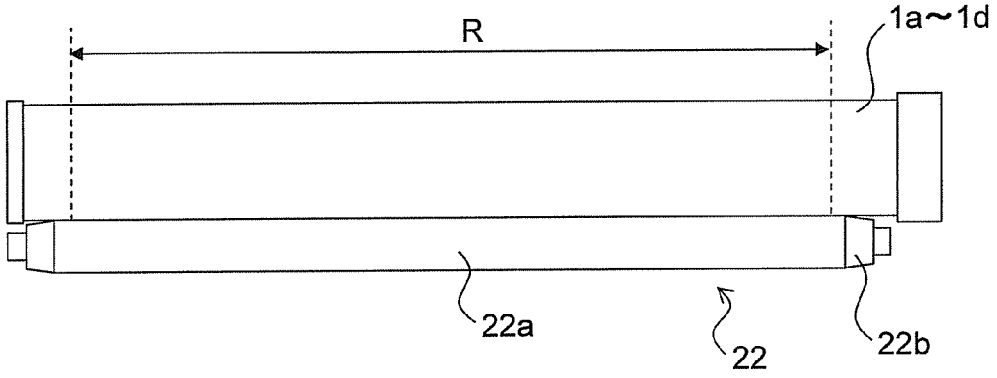
FIG. 6A is a plan view showing a positional relationship between a photosensitive drum 1*a* to 1*d* and a charging roller 22 during printing operation in a color printer 100 according to a second embodiment of the present disclosure.
Figure 6B:
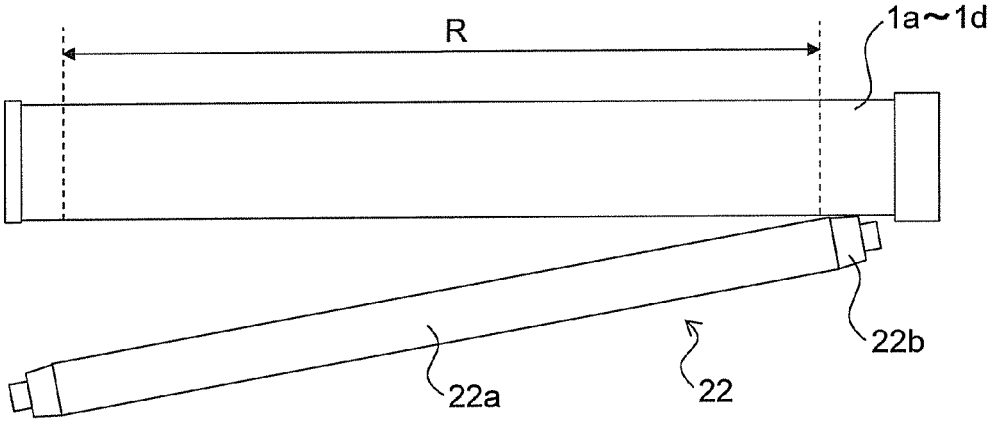
FIG. 6B is a plan view showing a positional relationship between a photosensitive drum 1*a* to 1*d* and a charging roller 22 during execution of a temperature raising mode in a color printer 100 according to the second embodiment.

FIGS. 6A and 6B are plan views showing the positional relationship between the photosensitive drum 1*a* to 1*d* and the charging roller 22 during printing operation and during execution of temperature raising mode in a color printer 100 according to a second embodiment of the present disclosure. In this embodiment, the charging roller 22 has a first, cylindrical, contact surface 22*a* which is formed in a central part of the charging roller 22 in its longitudinal direction and which makes contact with the image formation region R of the photosensitive drum 1*a* to 1*d* during printing operation and a second, tapered, contact surface 22*b* which is formed at both end parts of the charging roller 22 in its longitudinal direction and which makes contact with a region of the photosensitive drum 1*a* to 1*d* outside the image formation region R during execution of temperature raising mode.

During printing operation, as shown in FIG. 6A, the charging roller 22 is arranged parallel to the photosensitive drum 1*a* to 1*d*, and the first contact surface 22*a* of the charging roller 22 is in contact with the image formation region R of the photosensitive drum 1*a* to 1*d* over the entire area in its width direction. This permits the image formation region R to be electrically charged uniformly. In this state, the second contact surface 22*b* is not in contact with the photosensitive drum 1*a* to 1*d*.

On the other hand, during execution of the temperature raising mode, as shown in FIG. 6B, the charging roller 22 is arranged with an inclination to the photosensitive drum 1*a* to 1*d*, and the second contact surface 22*b* of the charging roller 22 is in contact with a region on the photosensitive drum 1*a* to 1*d* outside the image formation region R. In this state, the first contact surface 22*a* is not in contact with the photosensitive drum 1*a* to 1*d*.

Accordingly, during execution of the temperature raising mode, even if application of the AC bias to the charging roller 22 promotes electrostatic destruction (dielectric breakdown) of the photosensitive layer at the surface of the photosensitive drum 1*a* to 1*d*, as in the first embodiment, the dielectric breakdown progresses in a region outside the image formation region R where the second contact surface 22*b* of the charging roller 22 is in contact. This prevents an adverse effect on the image.

Moreover, during image formation and during execution of the temperature raising mode (other than during image formation), different parts of the charging roller 22 make contact with the photosensitive drum 1*a* to 1*d*. Thus, even if deterioration due to energization (a rise in resistance) occurs in the contact part (the second contact surface 22*b*) of the charging roller 22 during execution of the temperature raising mode, this has no influence on the contact part (the first contact surface 22*a*) of the charging roller 22 during image formation. Thus, it is possible to prevent uneven charging in the image formation region R of the photosensitive drum 1*a* to 1*d*.

Next, the relationship between presence/absence of rotation of the photosensitive drum 1*a* to 1*d* and the temperature raising effect of the photosensitive drum 1*a* to 1*d* was studied. In a tandem-type color printer 100 as shown in FIG. 1, as the photosensitive drum 1*a* to 1*d*, an a-Si photosensitive drum having an a-Si photosensitive layer stacked on the surface of an aluminum pipe with an external diameter of 30 mm and a thickness of 2 mm was used, and a charging roller 22 with an external diameter of 12 mm and with a wall thickness of 2 mm was brought into contact with it. Here, with respect to the entire system constituted by the photosensitive drum and the charging roller, the capacitance C was 600 pF and the resistance R was 1.3 MΩ.

Moreover, as the charge bias which is applied to the charging roller 22 during the temperature raising mode, a bias was set that had an AC bias having a peak-to-peak value (Vpp) of 1600 V superimposed on a DC bias (Vdc) of 350 V. As the charge bias which is applied to the charging roller 22 during printing operation, a bias was set which had an AC bias having a peak-to-peak value (Vpp) of 1200 V and a frequency of 2300 Hz superimposed on a DC bias (Vdc) of 400 V.

Then, in an environment of 28° C., 80% RH, in a state where the photosensitive drum 1*a* to 1*d* was rotated at the same linear speed as during printing operation (157 mm/sec), in a state where the photosensitive drum 1*a* to 1*d* was rotated at one-half of the linear speed during printing operation (78.5 mm/sec), and in a state where the photosensitive drum 1*a* to 1*d* is stopped, how the temperature rise amount at the surface of the photosensitive drum 1*a* to 1*d* varied was measured. The results are shown in FIG. 7.

Figure 7:
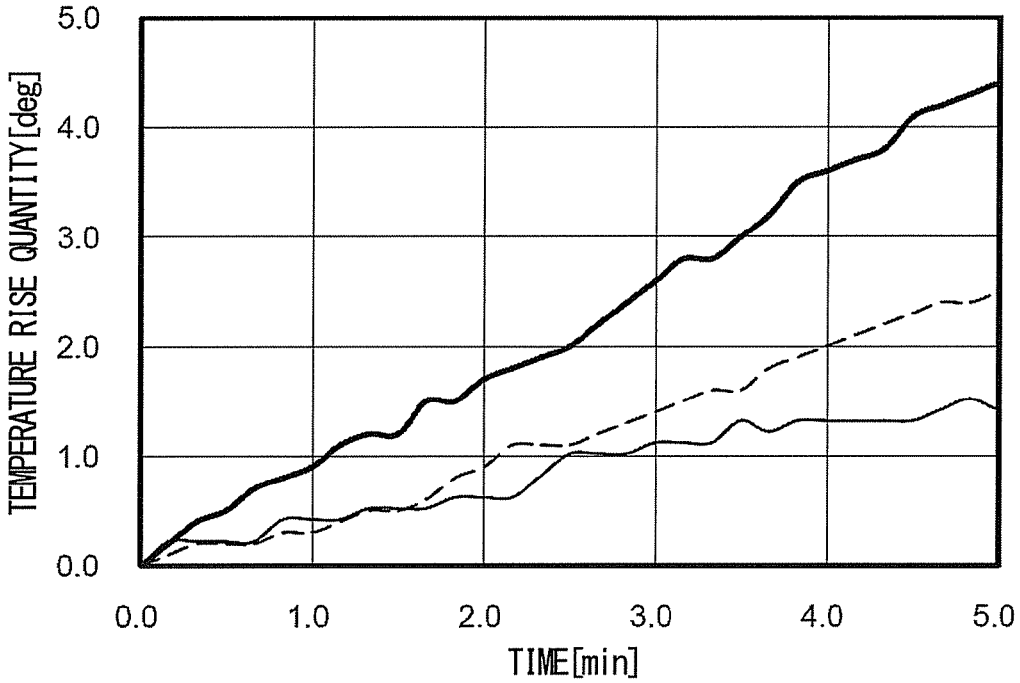
FIG. 7 is a graph showing the temperature rise amount of a photosensitive drum 1*a* to 1*d* when a temperature raising mode is executed in a state where the photosensitive drum 1*a* to 1*d* is rotated at the sane linear speed as during printing operation, in a state where the photosensitive drum 1*a* to 1*d* is rotated at one-half of the linear speed during printing operation, and in a state where the photosensitive drum 1*a* to 1*d* is stopped.

As shown in FIG. 7, when the temperature raising mode was executed with the photosensitive drum 1*a* to 1*d* stopped (the bold line in FIG. 7), the temperature rise amount at the surface of the photosensitive drum 1*a* to 1*d* was 4.0 degrees or more in five minutes. In comparison, when the temperature raising mode was executed with the photosensitive drum 1*a* to 1*d* rotated at one-half of the linear speed during printing operation (the broken line in FIG. 7), the temperature rise amount at the surface of the photosensitive drum 1*a* to 1*d* was 2.5 degrees in five minutes, and when the temperature raising mode was executed with the photosensitive drum 1*a* to 1*d* rotated at the same the linear speed as during printing operation (the solid line in FIG. 7), the temperature rise amount at the surface of the photosensitive drum 1*a* to 1*d* was 1.5 degrees in five minutes. This is considered to be due to lower temperature raising efficiency resulting from the photosensitive drum 1*a* to 1*d* being cooled by a stream of air occurring around them when the AC bias is applied to the charging roller 22 with the photosensitive drum 1*a* to 1*d* rotating.

Accordingly, by applying the bias to the charging roller 22 with the photosensitive drum 1*a* to 1*d* rotated at lower speed during the temperature raising mode than during image formation, it is possible to suppress occurrence of a striped image defect without lowering temperature raising efficiency at the surface of the photosensitive drum 1*a* to 1*d*. To minimize lowering of temperature rising efficiency at the surface of the photosensitive drum 1*a* to 1*d*, it is preferable that the rotation speed of the photosensitive drum 1*a* to 1*d* during the temperature raising mode be sufficiently lower than during image formation. Furthermore, it is preferable that the AC bias be applied to the charging roller 22 with the rotation of the photosensitive drum 1*a* to 1*d* stopped.

Incidentally, when the bias is applied to the charging roller 22 with the rotation of the photosensitive drum 1*a* to 1*d* stopped, electric discharge concentrates in the part of the surface of the photosensitive drum 1*a* to 1*d* where it makes contact with the charging roller 22, and this may cause the potential in that part to be lower than elsewhere, or may cause dielectric breakdown to occur. However, as shown in FIGS. 5B and 6B, the part with which the charging roller 22 makes contact during the temperature raising mode is located outside the image formation region R on the photosensitive drum 1*a* to 1*d*. Thus, even when the AC bias is applied to the charging roller 22 with the rotation of the photosensitive drum 1*a* to 1*d* stopped, the output image is unlikely to be adversely affected.

Next, the relationship between the factor of the AC bias applied to the charging roller 22 and the temperature raising effect of the photosensitive drum 1*a* to 1*d* was studied. The photosensitive drum 1*a* to 1*d* and the charging roller 22 of the color printer 100 had the same specifications as mentioned above. The charge biases applied to the charging roller 22 during the temperature raising mode and during printing operation were the same as mentioned above.

Figure 8:
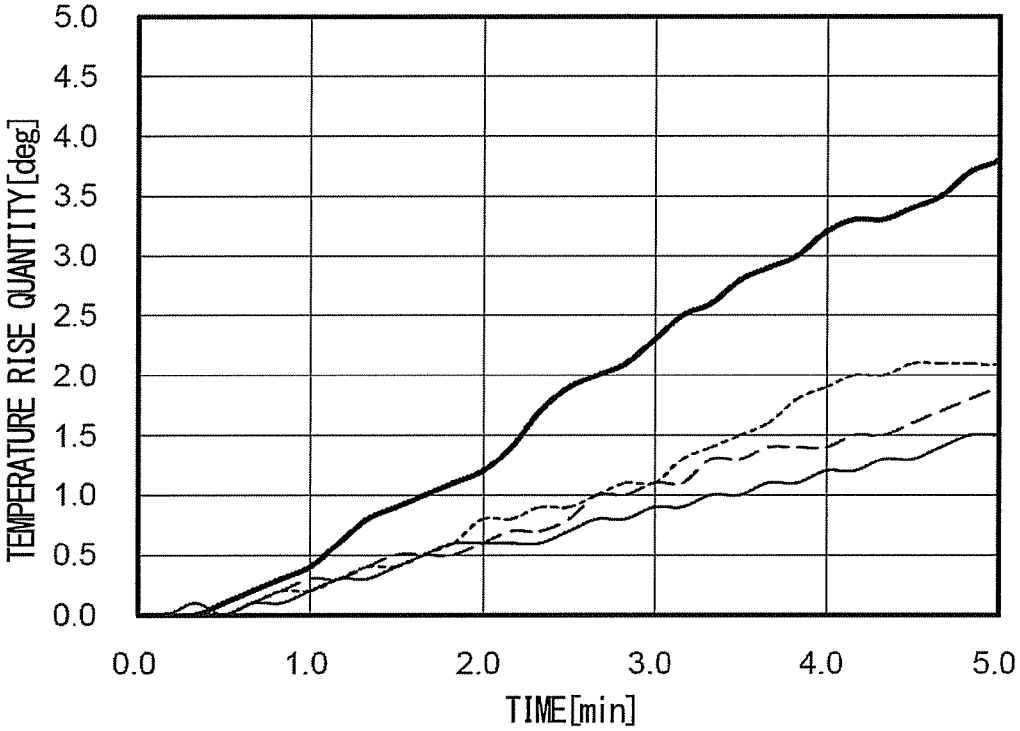
FIG. 8 is a graph showing the temperature rise amount of a photosensitive drum 1*a* to 1*d* when a temperature raising mode is executed with an AC bias applied to a charging roller 22 with different frequencies f.

Then, in an environment of 28° C., 80% RH, the temperature raising mode is executed with the photosensitive drum 1*a* to 1*d* stopped, and while the frequency f of the AC bias applied to the charging roller 22 was varied from 2400 Hz to 5000 Hz, how the temperature rise amount at the surface of the photosensitive drum 1*a* to 1*d* varied was measured. The results are shown in FIG. 8. In FIG. 8, the temperature rise amount with the frequency f at 2400 Hz is indicated by a solid line, the temperature rise amount with the frequency f at 3000 Hz is indicated by a broken line, the temperature rise amount with the frequency f at 4000 Hz is indicated by a dotted line, and the temperature rise amount with the frequency f at 5000 Hz is indicated by a bold line.

As will be clear from FIG. 8, the higher the frequency f of the AC bias applied to the charging roller 22, the greater the temperature rise amount at the surface of the photosensitive drum 1*a* to 1*d*. It is known that image dropouts do not occur at relative humidity of 70% or less. In an environment of 28° C., 80% RH, to reduce the relative humidity to 70% or less, it is necessary to raise the surface temperature of the photosensitive drum 1*a* to 1*d* to 30.2° C. or more.

Accordingly, when the target value of the temperature rise amount is set at (30.2−28.0)=2.2 degrees, then, from FIG. 8, it is found that the time required for temperature raising is, when the frequency f is 5000 Hz, 2.8 minutes and, when the frequency f is 4000 Hz, 4.2 minutes, and when the frequency f is 3000 Hz or less, five minutes or more. Typically, the time required for warming-up of the color printer 100 is set at about five minutes, and accordingly, by setting the frequency f at 4000 Hz or more in an environment of 28° C., 80% RH, it is possible to raise, within the time required for warming-up, the surface temperature of the photosensitive drum 1*a* to 1*d* up to a temperature at which no image dropouts occur.

The temperature rise amount at the surface of the photosensitive drum 1*a* to 1*d* that is required to prevent image dropouts varies with the environment (temperature and humidity) around the color printer 100. Thus, by storing in the ROM 92 (or the RAM 93) an environment compensation table in which optimal bias application times corresponding to different environments are set, and continuing application of an AC bias for the minimal time required to remove moisture on the surface of the photosensitive drum 1*a* to 1*d* during execution of the temperature raising mode, it is possible to minimize the user wait time and to maximize image formation efficiency.

Though not discussed here, when the frequency f was set at 2300 Hz as during printing operation, no sufficient temperature raising effect was observed. This result confirms that, to effectively raise the temperature of the photosensitive drum 1*a* to 1*d*, it is preferable to set the frequency f of the AC bias applied to the charging roller 22 higher than during printing operation.

Incidentally, as described above, in the temperature raising mode executed on the color printer 100, the AC bias is applied to the charging roller 22 in a state different than during printing operation, that is, with the photosensitive drum 1*a* to 1*d* in a stopped state, and thus the electric discharge region concentrates in a given part on the surface of the photosensitive drum 1*a* to 1*d*. Thus, if an excessive AC bias is applied to the charging roller 22, exchange of discharged electric charges promotes dielectric breakdown of the photosensitive layer, and this may lead to image defects such as colored spots or colored stripes. It may also lead to alteration or deterioration of the electrically conductive material forming the charging roller 22. Thus, it is necessary to apply an adequate AC bias to the charging roller 22.

Figure 9:
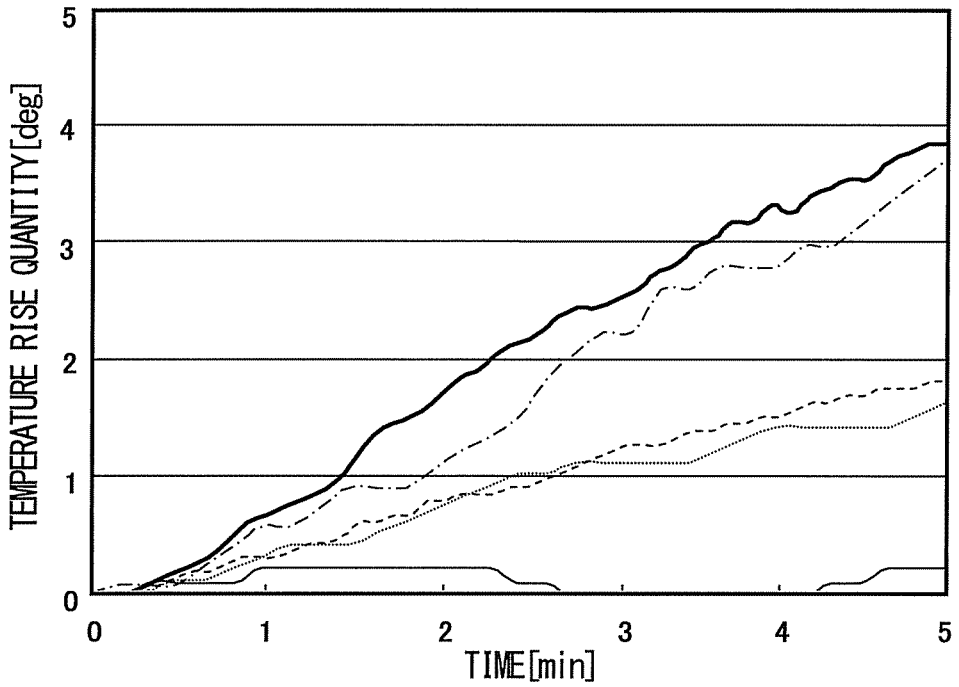
FIG. 9 is a graph showing the temperature rise amount of a photosensitive drum 1*a* to 1*d* when a temperature raising mode is executed with an AC bias applied to a charging roller 22 with different frequencies f and different Vpp's.

To set the adequate peak-to-peak value (Vpp) of the AC bias applied to the charging roller 22, under test conditions similar to those in FIG. 7, while the frequency f of the AC bias applied to the charging roller 22 was varied between 3000 Hz and 5000 Hz and the Vpp was varied in the range from 1000 V to 1600 V, how the temperature rise amount at the surface of the photosensitive drum 1*a* to 1*d* varied was measured. The results are shown in FIG. 9. In FIG. 9, the temperature rise amount with the frequency f at 3000 Hz and the Vpp at 1000 V is indicated by a solid line, the temperature rise amount with the frequency f at 3000 Hz and the Vpp at 1200 V is indicated by a dotted line, the temperature rise amount with the frequency f at 3000 Hz and the Vpp at 1600 V is indicated by a broken line. The temperature rise amount with the frequency f at 5000 Hz and the Vpp at 1200 V is indicated by a dash-and-dot line, and the temperature rise amount with the frequency f at 5000 Hz and the Vpp at 1600 V is indicated by a bold line.

As will be clear from FIG. 9, according to the Vpp of the AC bias applied to the charging roller 22, the temperature rise amount characteristics at the surface of the photosensitive drum 1*a* to 1*d* vary. By applying an AC bias with a Vpp of 1200 V, it is possible to obtain a temperature raising effect similar to that obtained by applying an AC bias with a Vpp of 1600 V. On the other hand, it is found that applying an AC bias with a Vpp of 1000 V produces almost no temperature raising effect. Here, the Vpp of 1200 V at which a temperature raising effect was observed is twice as high as the discharge start voltage Vth between the charging roller 22 and the photosensitive drum 1*a* to 1*d*.

In the present specification, the "discharge start voltage" denotes the voltage value at which electric discharge occurs between the charging roller 22 and the photosensitive drum 1*a* to 1*d* when a DC bias is applied to the charging roller 22 and the voltage value of the DC bias is increased gradually.

That is, by setting an AC bias having a Vpp twice as high as the discharge start voltage Vth or more as the value of the AC bias applied to the charging roller 22, it is possible to raise the temperature of the photosensitive drum 1*a* to 1*d*. In particular, by setting the Vpp of the AC bias at twice as high as the discharge start voltage Vth, it is possible, while maintaining stable electric discharge, to raise the temperature of the photosensitive drum 1*a* to 1*d*. In this way, it is possible to minimize damage to the photosensitive layer due to application of an excessive voltage, and simultaneously to effectively suppress occurrence of image dropouts.

To summarize, during execution of the temperature raising mode, it is necessary to apply to the charging roller 22 an AC bias having a Vpp equal to or higher than twice the discharge start voltage Vth between the charging roller 22 and the photosensitive drum 1*a* to 1*d*, and it is preferable to apply an AC bias having a higher frequency than during printing operation.

Here, the discharge start voltage Vth varies also with the installation environment of the color printer 100, the resistance of the charging roller 22, etc. To keep the temperature raising efficiency of the photosensitive drum 1*a* to 1*d* constant, therefore, it is preferable to measure the discharge start voltage Vth at predetermined time intervals and to determine the Vpp of the AC bias applied to the charging roller 22 based on the so measured discharge start voltage Vth. Even with a constant Vpp, the higher the frequency f, the stronger the temperature raising effect of the photosensitive drum 1*a* to 1*d*. Thus, it is preferable to set the frequency f slightly higher to shorten the temperature raising time (AC bias application time) to reduce damage to the photosensitive layer.

Figure 10:
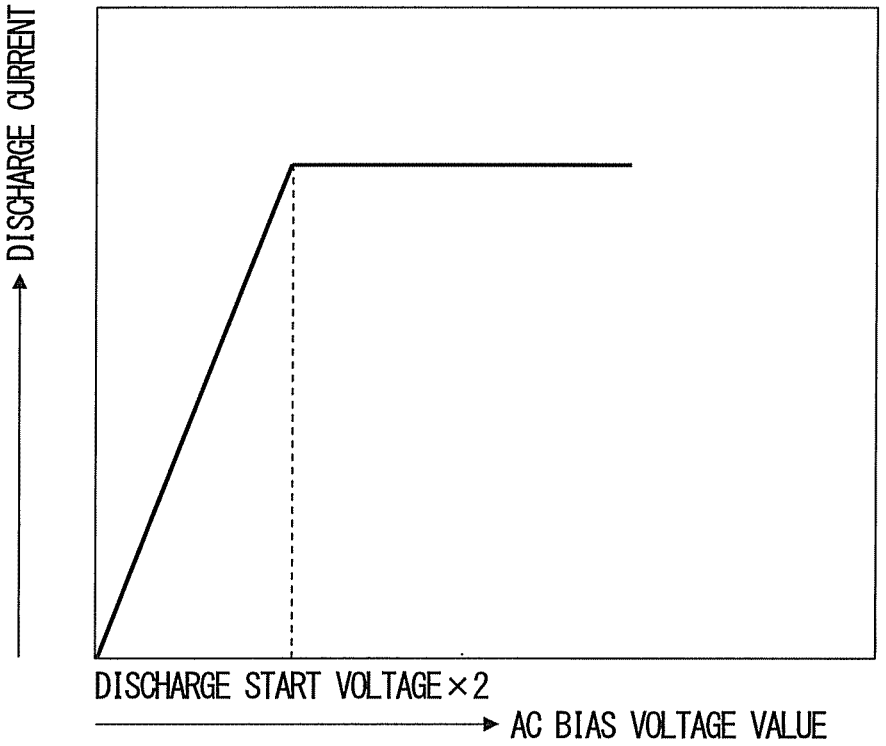
FIG. 10 is a graph showing how a charge current behaves when the Vpp of an AC bias applied to a charging roller 22 is increased.

The discharge start voltage Vth is measured, for example, in the following manner. When the discharge current is measured while the Vpp of the AC bias is increased, as shown in FIG. 10, the discharge current increases in proportion to the Vpp, stops increasing when the Vpp reaches a predetermined value, and thereafter remains at an approximately constant value. The turning point of the discharge current, that is, the Vpp, is twice as high as the discharge start voltage Vth. A tendency as shown in FIG. 10 is observed not only with the discharge current value but also with, for example, the surface potential of the photosensitive drum 1*a* to 1*d*, and therefore it is also possible to measure the discharge start voltage Vth based on variation of the surface potential of the photosensitive drum 1*a* to 1*d*.

In the embodiment described above, the temperature raising mode is executed by applying an AC bias to the charging roller 22. The member to which the AC bias is applied is not limited to the charging roller 22, but may instead be any electrically conductive member that makes contact with the photosensitive drum 1*a* to 1*d*. An example of such an electrically conductive member is the cleaning roller 27. Application of an AC bias to the cleaning roller 27 is performed by the cleaning bias power supply 45.

If an electrically conductive member that is used with a bias applied to it during printing operation, like the charging roller 22, is supplied with a bias also other than during printing operation, deterioration of the electrically conductive member may progress faster, shortening its service life. If, as an electrically conductive member to which a bias is applied other than during printing operation, a member to which no bias is applied during printing operation, like the cleaning roller 27, is used, there is no need to consider shortening of service life.

Incidentally, an electrically conductive member that makes contact with the photosensitive drum 1*a* to 1*d*, such as the charging roller 22 or the cleaning roller 27, typically has a roller body of an electrically conductive material fixed to a metal shaft with adhesive. Thus, when a high-frequency AC bias is applied to it, the adhesive may come off. By using, instead, a charging roller 22 and a cleaning roller 27 in which no adhesive is used to fix the metal shaft and the roller body together, it is possible to raise the temperature of the photosensitive drum 1*a* to 1*d* in a short time without causing the electrically conductive material and the shaft to come off each other on application of the AC bias. One method of fixing the metal shaft and the roller body together without using adhesive is to press-fitting the shaft into the roller body.

Next, a color printer 100 according to a third embodiment of the present disclosure will be described. The configuration and the control paths of the color printer 100 are the same as those in the first embodiment shown in FIGS. 1 to 5. In the color printer 100 according to this embodiment, the frequency f of the AC bias applied to the charging roller 22 in the temperature raising mode is varied according to the use environment (temperature and humidity) of the color printer 100.

As described above, the higher the frequency f of the AC bias, the stronger the temperature raising effect of the photosensitive drum 1*a* to 1*d*. On the other hand, as the frequency f is increased, the surface of the photosensitive drum 1*a* to 1*d* becomes increasingly prone to be deposited with electric discharge products. This increases the coefficient of friction p at the surface of the photosensitive drum 1*a* to 1*d*, and causes rubbing of the cleaning blade 28 and fricative noise.

However, in an environment where image dropouts are likely to occur, as in a high-temperature, high-humidity environment, it is necessary to sufficiently raise the temperature of the photosensitive drum 1*a* to 1*d* to suppress image dropouts and also to shorten the user wait time to enhance convenience. Accordingly, based on the temperature and humidity inside the color printer 100 (the inside temperature and the inside humidity), the frequency f of the AC bias applied to the charging roller 22 is varied.

Figure 11:
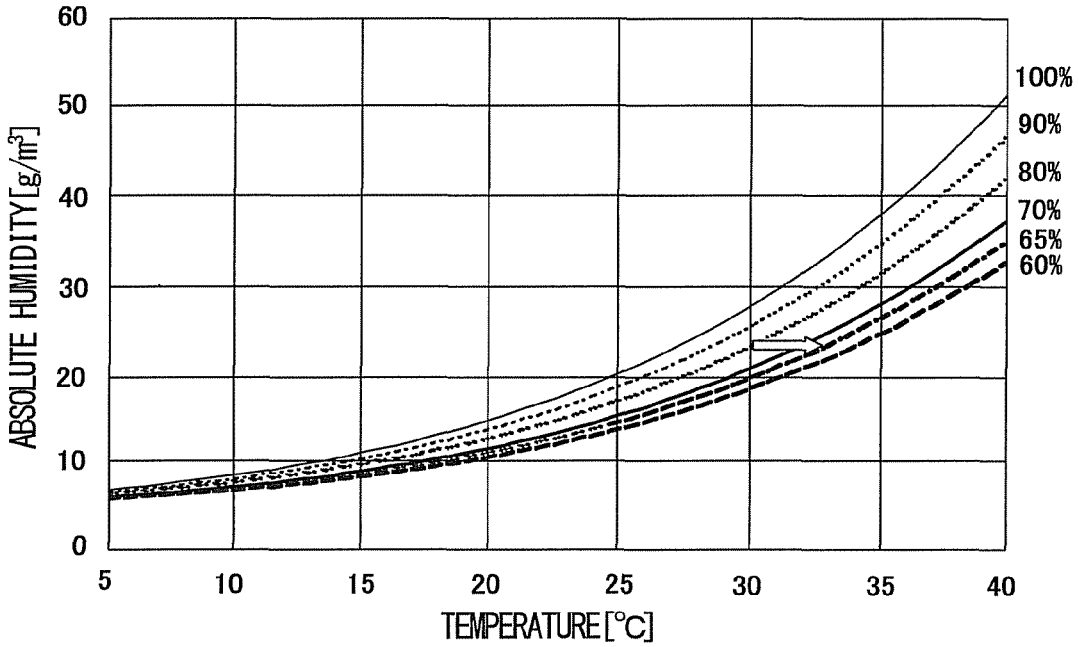
FIG. 11 is a graph showing a relationship between inside temperature (° C.) and absolute humidity (g/cm$^3$) at relative humidities of 60%, 65%, 70%, 80%, 90%, and 100%.

FIG. 11 is a graph (saturated water vapor curve) showing the relationship between the inside temperature (° C.) and the absolute humidity (g/cm$^3$) at relative humidities of 60%, 65%, 70%, 80%, 90%, and 100%. For example, suppose that the color printer 100 is installed in an environment of 30° C., 80% RH. Then, the photosensitive drum 1*a* to 1*d* inside the color printer 100 is considered to be in a similar environment. From FIG. 11, the absolute humidity with an inside temperature of 30° C. and a relative humidity of 80% is 24.3 g/cm$^3$.

Here, the absolute humidity represents the amount of moisture in the air, and thus, if it is assumed that variation in the inside temperature does not cause variation in the absolute humidity, as the surface temperature of the photosensitive drum 1*a* to 1*d* rises, as indicated by an arrow in FIG. 9, the relative humidity lowers. For example, when the surface temperature of the photosensitive drum 1*a* to 1*d* rises to 33.9° C., the relative humidity becomes 65%, and no image dropouts occur.

Let the inside temperature be IT [° C.], the inside humidity be IH [% RH], the surface temperature of the photosensitive drum 1*a* to 1*d* be PT [° C.], and the relative humidity around the photosensitive drum 1*a* to 1*d* be PH [% R|]. Then, the inside saturated water vapor pressure e(IT), the inside saturated water vapor amount a(IT), the inside absolute humidity A(IH), and the saturated water vapor pressure e(PT) around the photosensitive drum 1*a* to 1*d* are given by the following equations respectively:

$$e(IT)=6.1078\times10^{7.5\times IT/(IT+237.3)}[hpa]$$

$$a(IT)=217\times e(IT)/(IT+273.15)[\mathrm{g/m^3}]$$

$$A(IH)=a(IT)\times IH/100[\mathrm{g/m^3}]$$

$$e(PT)=6.1078\times10^{7.5\times PT/(PT+2373)}[hPa]$$

Figure 12:
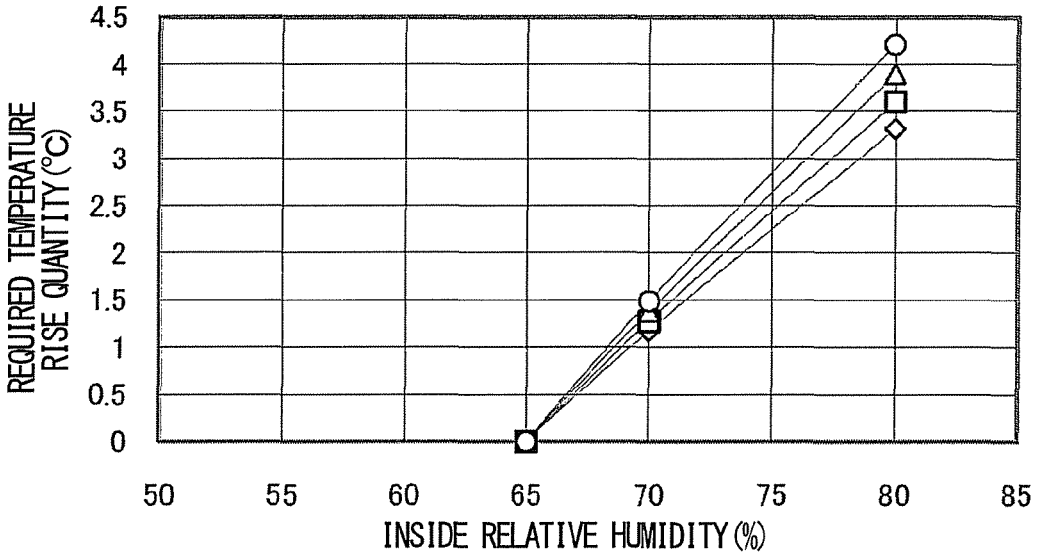
FIG. 12 is a graph showing the temperature rise amount of the surface temperature of a photosensitive drum 1*a* to 1*d* that is required to reduce the relative humidity around the photosensitive drum 1*a* to 1*d* to 65% or less.

FIG. 12 is a graph showing the temperature rise amount of the surface temperature of the photosensitive drum 1*a* to 1*d* that is required to reduce the relative humidity around the photosensitive drum 1*a* to 65% or less. In FIG. 12, the temperature rise amount required with the inside temperature at 10° C. is represented by a series of data indicated by diamonds, at 20° C. by a series of data indicated by squares, at 30° C. by a series of data indicated by triangles, and at 40° C. by a series of data indicated by circles.

As will be clear from FIG. 12, according to the inside temperature and humidity conditions, the required temperature rise amount varies, and the required temperature rise amount increases as the inside relative humidity increases. Accordingly, as shown in FIG. 6, it is effective to vary the frequency f according to the installation environment of the color printer 100. Specifically, in a high-temperature, high-humidity environment, by increasing the frequency f, it is possible to strengthen the temperature raising effect of the photosensitive drum 1*a* to 1*d* and to shorten the user wait time. On the other hand, in a low-temperature, low-humidity environment, by reducing the frequency f, it is possible to suppress an increase in the coefficient of friction p at the surface of the photosensitive drum 1*a* to 1*d*.

The inside temperature is detected at predetermined time intervals all the time by the inside temperature sensor 97*a*. The inside relative humidity is, assuming that the absolute amount of moisture (which depends on temperature) is the same inside and outside the apparatus, calculated from the outside humidity, which is detected at predetermined time intervals by the outside humidity sensor 98, and the inside temperature.

It is preferable to vary the frequency in the temperature raising mode by use of the temperature and humidity detected immediately before the varying. The temperature and humidity detected with other timing may instead be used. The temperature and humidity may even be detected a predetermined number of times and the averages of the detected values may be used.

Next, a color printer 100 according to a fourth embodiment of the present disclosure will be described. The configuration and the control paths of the color printer 100 are the same as those in the first embodiment shown in FIGS. 1 to 5. In the color printer 100 according to this embodiment, the frequency f of the AC bias applied to the charging roller 22 in the temperature raising mode is varied according to the cumulative number of sheets printed after the start of use of the photosensitive drum 1*a* to 1*d*.

Generally, with an a-Si photosensitive drum, through use for a long period, the photosensitive layer is oxidized and becomes prone to adsorb water molecules and electric discharge products. Also, additives added to the charging roller 22 seep out. Thus, as the drum unit including the photosensitive drum 1*a* to 1*d* is used longer and longer, occurrence of image dropouts becomes more notable, and the time required to eliminate image dropouts becomes longer than during initial use.

In this embodiment, according to the cumulative number of sheets printed (the durable number of sheets) after the start of use of the photosensitive drum 1*a* to 1*d* as counted by the counter 95 (see FIG. 3), the frequency of the AC bias applied to the charging roller 22 is varied. This makes it possible to eliminate image dropouts in a short time even near the end of the durable period of the drum unit.

Typically, the warming-up time of the color printer 100 is set at about 5 minutes. Accordingly, in an environment of 28° C., 80% RH, while the frequency f of the AC bias applied to the charging roller 22 is varied, the temperature raising mode was executed, and whether or not image dropouts can be eliminated within five minutes was studied for each of different energization times (cumulative numbers of sheets printed) after the start of use of the photosensitive drum 1*a* to 1*d*.

The photosensitive drum 1*a* to 1*d* and the charging roller 22 of the color printer 100 had the same specifications as in the first embodiment. The charge bias applied to the charging roller 22 in the temperature raising mode was the same as in the first embodiment, namely with a DC bias (Vdc) of 350 V and an AC bias having a peak-to-peak value (Vdc) of 1800V. The charge bias applied to the charging roller 22 during printing operation also was the same as in the first embodiment, namely with a DC bias (Vdc) of 400 V and an AC bias having a peak-to-peak value (Vdc) of 1200 V and a frequency of 2300 Hz. The results are shown in Table 1.

TABLE 1

| Cumulative Number of Sheets Printed | 4000 Hz | 5000 Hz | 6000 Hz | 7000 Hz |
|---|---|---|---|---|
| 0 k | Good | Good | Good | Good |
| 50 k | Good | Good | Good | Good |
| 100 k | NG | Good | Good | Good |
| 300 k | NG | NG | Good | Good |
| 600 k | NG | NG | NG | Good |

As shown in Table 1, until the cumulative number of sheets printed reaches 50 k sheets (50,000 sheets), image dropouts were eliminated within five minutes by applying an AC bias having a frequency of 4000 Hz. Thereafter, as the cumulative number of sheets printed increased to 100 k sheets (100,000 sheets), 300 k sheets (300,000 sheets), and 600 k sheets (600,000 sheets), the frequency of the AC bias required to eliminate image dropouts within five minutes increased to 5000 Hz, 6000 Hz, and 7000 Hz.

The results reveal the following: by setting the frequency low (4000 Hz or less) during an initial use period of the photosensitive drum 1*a* to 1*d* and increasing it stepwise as the cumulative number of sheets printed increases, it is possible to effectively suppress occurrence of image dropouts over the entire durable period of the photosensitive drum 1*a* to 1*d*, and to suppress an increase in the coefficient of friction p at the surface of the photosensitive drum 1*a* to 1*d*, and to shorten the warming-up time.

Next, a color printer 100 according to a fifth embodiment of the present disclosure will be described. The configuration and the control paths of the color printer 100 are the same as in the first embodiment shown in FIGS. 1 to 5. In the color printer 100 according to this embodiment, during execution of the temperature raising mode, such a high-frequency AC bias as not to cause electric discharge to occur between the charging roller 22 and the photosensitive drum 1*a* to 1*d* is applied to the charging roller 22.

Figure 13:
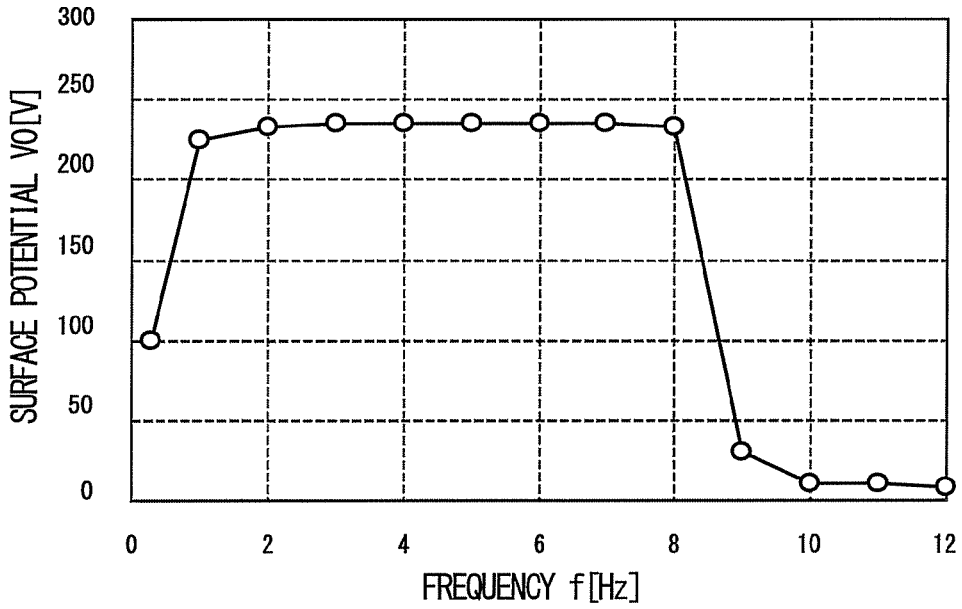
FIG. 13 is a graph showing how the surface potential V0 of a photosensitive drum 1*a* to 1*d* varies when the frequency f of an AC bias applied to a charging roller 22 is varied from 0 kHz to 12 kHz.

FIG. 13 is a graph showing how the surface potential V0 of the photosensitive drum 1*a* to 1*d* varies when the frequency f of the AC bias applied to the charging roller 22 is varied from 0 kHz to 12 kHz. The other testing conditions were the same as in FIGS. 7 and 8.

Moreover, Table 2 shows the relationship between the time it took for the surface of the photosensitive drum 1*a* to 1*d* to reach the target temperature (here, 30.2° C.) and the damage to the photosensitive drum 1*a* to 1*d* and the charging roller 22 as observed while the frequency f of the AC bias was varied from 4 kHz to 10 kHz. In Table 2, the damage to the photosensitive drum 1*a* to 1*d* and the charging roller 22 was checked through visual inspection of the level of roller stripes observed when a halftone image was printed. A level of roller stripes so notable as to be unacceptable in practical use was evaluated as "NG," a level of roller stripes noticeable but acceptable in practical use was evaluated as "Fair," and a level of roller stripes unnoticeable was evaluated as "Good."

TABLE 2

| Frequency | Speed of Temperature rise amount Up To Target Temperature | Damage to Photosensitive body and Charging Roller |
|---|---|---|
| 4 kHz | 4.2 Minutes | NG |
| 6 kHz | 2.5 Minutes | NG |
| 8 kHz | 2.1 Minutes | Fair |
| 10 kHz | 2.0 Minutes | Good |

As shown in FIG. 13, it was found that, while the frequency f of the AC bias applied to the charging roller 22 is 1 kHz to 8 kHz, the surface potential V0 is high, namely 230 V to 250 V, and when the frequency f becomes 8 kHz or more, V0 falls sharply. This is because, since the electrically conductive material of which the charging roller 22 is formed contains an ion-conductive agent, setting the frequency f of the AC bias at a high frequency equal to or higher than a certain value makes ions in the electrically conductive material unable to oscillate to follow the frequency f, and thus electric discharge no longer occurs.

Moreover, as shown in Table 2, it was confirmed that the higher the frequency f, the higher the speed of temperature rise at the surface of the photosensitive drum 1*a* to 1*d*, and that, at 8 kHz or more, the damage to the photosensitive drum 1*a* to 1*d* and the charging roller 22 is reduced.

Accordingly, in this embodiment, the frequency characteristics mentioned above are exploited. By applying to the charging roller 22 such a high-frequency AC bias as not to cause electric discharge to occur between the charging roller 22 and the photosensitive drum 1*a* to 1*d*, it is possible to exclusively cause oscillation of electrons and ions to raise the temperature of the photosensitive drum 1*a* to 1*d*. In this way, it is possible to minimize damage to the photosensitive layer resulting from concentration of the bias in a given place, and in addition effectively suppress occurrence of image dropouts.

Next, a color printer 100 according to a sixth embodiment of the present disclosure will be described. The configuration and the control paths of the color printer 100 are the same as in the first embodiment shown in FIGS. 1 to 5. In the color printer 100 according to this embodiment, during execution of the temperature raising mode, in addition to an AC bias, a DC bias equal to or lower than the discharge start voltage Vth between the charging roller 22 and the photosensitive drum 1*a* to 1*d* is applied to the charging roller 22.

Figure 14:
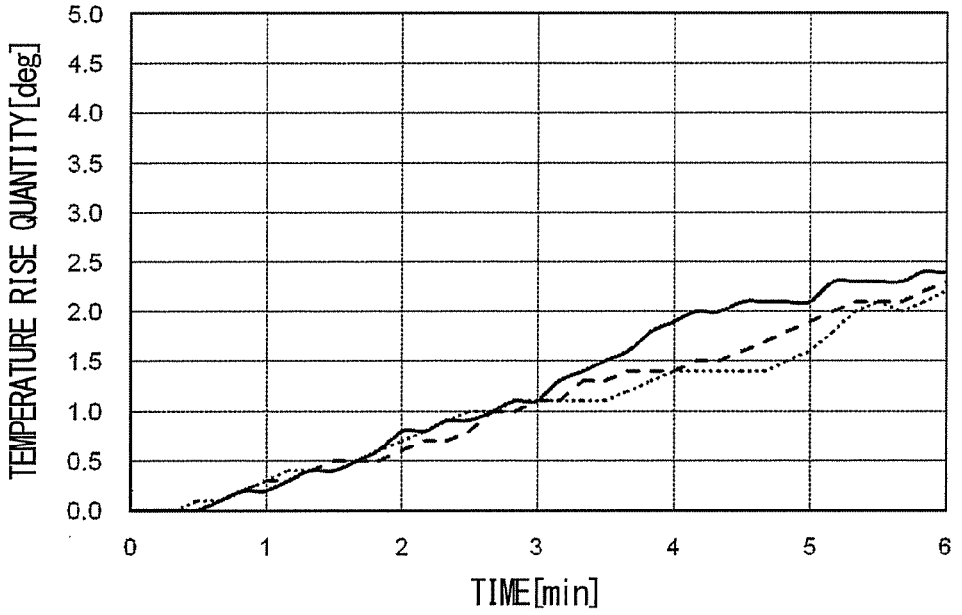
FIG. 14 is a graph showing how the temperature rise amount at the surface of a photosensitive drum 1*a* to 1*d* varies when, while the frequency f and the Vpp of an AC bias applied to a charging roller 22 are kept constant at 3000 Hz and 1600 V respectively, a DC bias Vdc is varied in steps of 0 V, 350 V, and 500 V.
Figure 15:
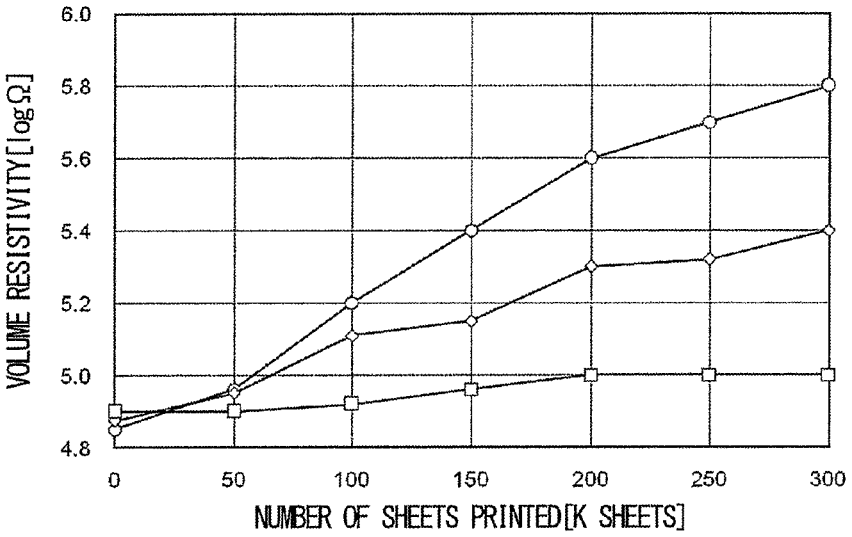
FIG. 15 is a graph showing how the volume resistivity of a charging roller 22 varies after durability printing when, while the frequency f and the Vpp of an AC bias applied to a charging roller 22 are kept constant at 3000 Hz and 1600 V respectively, a DC bias Vdc is varied in steps of 0 V, 350 V, and 500 V.

FIGS. 14 and 15 are graphs showing, respectively, variation of the temperature rise amount at the surface of the photosensitive drum 1*a* to 1*d* and variation of the volume resistivity of the charging roller 22 after durability printing, as observed when, with the frequency f and the VPP of the AC bias applied to the charging roller 22 kept constant at 3000 Hz and 1600 V respectively, the DC bias Vdc was varied in three steps, namely 0 V, 350 V, and 500 V. The other testing conditions were the same as in FIGS. 7 and 8.

As shown in FIG. 14, it was confirmed that, if the frequency f and the Vpp of the AC bias are constant, the temperature rise amount at the surface of the photosensitive drum 1*a* to 1*d* remains approximately constant irrespective of the DC bias Vdc. It is found that, when the target value of the temperature rise amount is set at (30.2−28.0)=2.2 (degrees), the time required for temperature raising is about six minutes irrespective of whether the DC bias Vdc is 0 V, 350 V, or 500 V.

Moreover, as shown in FIG. 15, it was confirmed that, as the DC bias Vdc increases, the volume resistivity of the charging roller 22 after durability printing increases, and that, with the DC bias Vdc at 0, almost no rise was observed in the volume resistivity of the charging roller 22 after printing of 300 k sheets (300,000 sheets).

During printing operation, by applying the DC bias Vdc to the charging roller 22, which has a predetermined resistance and a predetermined dielectric constant, it is electrically charged such that the surface potential of the photosensitive drum 1*a* to 1*d* is at a desired value. On the other hand, in the temperature raising mode, as described above, by applying a cyclic AC bias, the charging roller 22 is made to generate heat, and the DC bias is not quite necessary to make the charging roller 22 generate heat.

In addition, when the DC bias Vdc is applied, additives and the like contained in the charging roller 22 seep toward the photosensitive drum 1*a* to 1*d*, and this increases the volume resistivity of the charging roller 22. This shortens the durable period of the charging roller 22. Moreover, inconveniently, the part of the surface of the photosensitive drum 1*a* to 1*d* with which the charging roller 22 makes contact may be deposited with electric discharge products, or dielectric breakdown may cause leakage.

Accordingly, in this embodiment, the DC bias applied to the charging roller 22 during execution of the temperature raising mode is made as low as possible to suppress deterioration of the charging roller 22. Specifically, by making the DC bias applied to the charging roller 22 equal to or lower than the discharge start voltage Vth, it is possible to secure a satisfactory durable period of the charging roller 22, and in addition to prevent deposition of electrically conductive products on the surface of the photosensitive drum 1*a* to 1*d* and leakage due to dielectric breakdown.

Moreover, by setting the DC bias applied to the charging roller 22 during execution of the temperature raising mode at 0, it is possible to further suppress deterioration of the charging roller 22 and the photosensitive drum 1*a* to 1*d*. Furthermore, by applying to the charging roller 22 a DC bias having the opposite polarity (here, negative) to the DC bias (here, positive) applied during printing operation, it is possible to depolarize the polarized ions, and thus it is possible to prolong the durable period of the charging roller 22.

Next, a color printer 100 according to a seventh embodiment of the present disclosure will be described. The configuration and the control paths of the color printer 100 are the same as in the first embodiment shown in FIGS. 1 to 5. In the color printer 100 according to this embodiment, when no image is being formed, a temperature raising mode can be executed in which, with the charging roller 22 kept in contact with the photosensitive drum 1*a* to 1*d* outside the image formation region, an AC bias is applied to the charging roller 22 and in addition an AC bias is applied also to the cleaning roller 27 to raise the temperature of the surface of the photosensitive drum 1*a* to 1*d*.

With the configuration according to this embodiment, by applying an AC bias to a plurality of electrically conductive members (here, the charging roller 22 and the cleaning roller 27) that make contact with the photosensitive drum 1*a* to 1*d*, as compared with in the first embodiment where the AC bias is applied to the charging roller 22 alone, it is possible to shorten the time required to raise the temperature of the surface of the photosensitive drum 1*a* to 1*d*, and thus to shorten the user wait time.

The embodiments described above are not meant to limit the present disclosure, which therefore allows for many modifications within its spirit. For example, the embodiments described above deal with examples where an a-Si photosensitive drum is used as the photosensitive drum 1*a* to 1*d*, the same description applies equally to cases where an organic photosensitive drum or a selenium-phosphorus photosensitive drum is used.

Moreover, the present disclosure is not limited to color printers 100 of an intermediary-transfer type as the one shown in FIG. 1, but may be applied to various image forming apparatuses such as copiers and printers of a direct-transfer type, monochrome copiers, digital multi-function printers, facsimile machines, etc. With a direct-transfer type, an electrically conductive transfer roller makes contact with a photosensitive drum to form a transfer nip portion. Thus, a temperature raising mode can be executed by applying an AC bias to the transfer roller.

The present disclosure finds application in removal of moisture at the surface of a photosensitive drum in an image forming apparatus employing a photosensitive drum as an image carrying body. In the light of the present disclosure, it is possible to remove moisture at the surface of a photosensitive drum efficiently in a short time. It is thus possible to provide an image forming apparatus that can effectively prevent occurrence of image dropouts for a long period.

What is claimed is:

1. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with only the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body.

2. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein, during execution of the temperature raising mode, a part of the first electrically conductive member which does not make contact with the image carrying body during image formation is kept in contact with the image carrying body outside the image formation region.

3. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein the temperature raising mode is executed with the image carrying body rotated at lower speed than during image formation.

4. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein the temperature raising mode is executed with rotation of the image carrying body stopped.

5. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein, during execution of the temperature raising mode, an AC bias having a higher frequency than during image formation is applied to the first electrically conductive member.

6. The image forming apparatus according to claim 5, further comprising a temperature/humidity detecting device which detects temperature and humidity inside the image forming apparatus, wherein the controller varies a frequency of the AC bias applied to the first electrically conductive member during execution of the temperature raising mode according to the temperature and the humidity detected by the temperature/humidity detecting device.

7. The image forming apparatus according to claim 5, wherein the controller increases a frequency of the AC bias applied to the first electrically conductive member during execution of the temperature raising mode stepwise according to an energization time of the image carrying body after a start of use thereof.

8. The image forming apparatus according to claim 5, wherein, during execution of the temperature raising mode, an AC bias having a frequency in such a range as not to cause electric discharge between the image carrying body and the first electrically conductive member is applied.

9. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein the bias application device is capable of applying to the first electrically conductive member a bias having an AC bias superimposed on a DC bias, and during execution of the temperature raising mode, the AC bias is applied with a DC bias superimposed thereon which is equal to or lower than the discharge start voltage between the first electrically conductive member and the image carrying body.

10. The image forming apparatus according to claim 9, wherein, during execution of the temperature raising mode, the DC bias applied to the first electrically conductive member equals zero.

11. The image forming apparatus according to claim 1, wherein the first electrically conductive member is an electrically conductive roller having a roller body of an electrically conductive dielectric material formed on a circumferential surface of a metal shaft.

12. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member;

a controller which controls the bias application device; and a second electrically conductive member which makes contact with the image carrying body, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and the controller executes the temperature raising mode with an AC bias applied to the first electrically conductive member and the second electrically conductive member.

13. The image forming apparatus according to claim 12, further comprising at least one additional second electrically conductive members, wherein the controller executes the temperature raising mode with an AC bias to the at least one additional second electrically conductive member, and no bias is applied to part of each second electrically conductive members during image formation.

14. An image forming apparatus comprising:

an image carrying body which has a photosensitive layer formed on a circumferential surface thereof;

a first electrically conductive member which makes contact with the photosensitive layer of the image carrying body;

a bias application device which applies a bias containing an AC bias to the first electrically conductive member; and a controller which controls the bias application device, wherein the image forming apparatus performs image formation on a surface of the image carrying body while rotating the image carrying body, and is capable of executing, while no image formation is being performed, a temperature raising mode in which, with the first electrically conductive member in contact with the image carrying body outside an image formation region, an AC (alternating-current) bias having a peak-to-peak value twice as high as a discharge start voltage between the first electrically conductive member and the image carrying body is applied to the first electrically conductive member to raise temperature of the surface of the image carrying body, and wherein the photosensitive layer formed on the circumferential surface of the image carrying body is an amorphous silicon photosensitive layer.

* * * * *